US008209769B1

(12) United States Patent
Ellis et al.

(10) Patent No.: US 8,209,769 B1
(45) Date of Patent: Jul. 3, 2012

(54) HANDS FREE BOMB SUIT TOOL CARRIER

(75) Inventors: Arthur W. Ellis, Bel Alton, MD (US); Matthew A. Johnson, Milford, PA (US); Lance A. Brown, Laplata, MD (US); Manuel R. Vega, El Paso, TX (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 244 days.

(21) Appl. No.: 12/802,452

(22) Filed: May 20, 2010

(51) Int. Cl.
*F41H 1/00* (2006.01)
*F41H 1/02* (2006.01)
*F41H 13/00* (2006.01)

(52) U.S. Cl. ..... 2/2.5; 89/36.05

(58) Field of Classification Search ..... 2/2.5; 89/36.05
See application file for complete search history.

(56) References Cited

U.S. PATENT DOCUMENTS

| | | | | | |
|---|---|---|---|---|---|
| 4,497,069 | A | * | 2/1985 | Braunhut | 2/2.5 |
| 4,669,125 | A | * | 6/1987 | Allen | 2/459 |
| 5,031,733 | A | * | 7/1991 | Chang | 190/1 |
| 5,060,314 | A | * | 10/1991 | Lewis | 2/2.5 |
| 5,240,156 | A | | 8/1993 | Sicotte et al. | |
| 5,331,683 | A | * | 7/1994 | Stone et al. | 2/2.5 |
| 5,431,318 | A | * | 7/1995 | Garcia | 224/192 |
| 5,584,737 | A | * | 12/1996 | Luhtala | 441/107 |
| 5,644,742 | A | | 7/1997 | Tishler et al. | |
| 5,644,792 | A | * | 7/1997 | Tishler et al. | 2/2.5 |
| 5,797,140 | A | * | 8/1998 | Davis et al. | 2/2.5 |
| 5,799,329 | A | * | 9/1998 | Hauschild | 2/102 |
| 5,829,653 | A | * | 11/1998 | Kaiser | 224/577 |
| 5,864,481 | A | * | 1/1999 | Gross et al. | 700/90 |
| 5,918,312 | A | | 7/1999 | Craren | |
| 5,966,747 | A | * | 10/1999 | Crupi et al. | 2/466 |
| 5,991,925 | A | * | 11/1999 | Wu | 2/102 |
| 6,012,162 | A | * | 1/2000 | Bullat | 2/2.5 |
| 6,029,270 | A | * | 2/2000 | Ost et al. | 2/2.5 |
| 6,105,382 | A | * | 8/2000 | Reason | 62/259.3 |
| 6,185,738 | B1 | * | 2/2001 | Sidebottom | 2/2.5 |
| 6,382,490 | B1 | * | 5/2002 | Divincenzo | 224/681 |

(Continued)

FOREIGN PATENT DOCUMENTS

WO WO2005/034677 A1 4/2005

(Continued)

OTHER PUBLICATIONS

Special Operations Technologies Bomb Tech and Explosive Breacher's Gear Brochure; www.specopstech.com.

*Primary Examiner* — Bobby Muromoto, Jr.
(74) *Attorney, Agent, or Firm* — Fredric J. Zimmerman

(57) ABSTRACT

A bomb suit carrier is constructed from a sheet of fabric material shaped to fit within the front torso portion of a bomb suit. A sheet of loop material is attached to the sheet of fabric material and a plurality of parallel straps are attached to the side of the sheet of fabric material having the sheet of loop material. The parallel straps form a pouch attachment ladder system and include loop material along their entire length. A hole passes through the sheet of fabric material to accommodate a rapid doffing handle of a bomb suit to which the bomb suit carrier is attached. An attachment mechanism is provided to secure the sheet of fabric material to the bomb suit.

19 Claims, 10 Drawing Sheets

U.S. PATENT DOCUMENTS

| | | | | |
|---|---|---|---|---|
| 6,662,373 | B2 | 12/2003 | Frank | |
| 6,681,400 | B1 * | 1/2004 | Mills | 2/2.5 |
| 6,685,071 | B2 * | 2/2004 | Prather | 224/576 |
| 6,698,024 | B2 * | 3/2004 | Graves et al. | 2/2.5 |
| 6,729,520 | B2 | 5/2004 | Gilbert | |
| 6,948,188 | B2 * | 9/2005 | D'Annunzio | 2/102 |
| 7,002,526 | B1 * | 2/2006 | Adams et al. | 343/718 |
| 7,020,897 | B2 * | 4/2006 | Johnson | 2/102 |
| 7,032,250 | B1 | 4/2006 | Davis et al. | |
| 7,047,570 | B2 * | 5/2006 | Johnson | 2/102 |
| 7,124,921 | B1 | 10/2006 | Hubbell | |
| 7,243,376 | B2 * | 7/2007 | Johnson | 2/102 |
| 7,424,748 | B1 * | 9/2008 | McDunn et al. | 2/2.5 |
| 7,441,278 | B2 * | 10/2008 | Blakeley | 2/2.5 |
| 7,636,948 | B1 * | 12/2009 | Crye et al. | 2/2.5 |
| 7,917,967 | B2 * | 4/2011 | Osborne | 2/2.5 |
| 7,971,516 | B2 * | 7/2011 | Hogan | 89/36.07 |
| 7,979,917 | B2 * | 7/2011 | Osborne | 2/2.5 |
| 7,987,523 | B2 * | 8/2011 | Cole et al. | 2/102 |
| 2003/0159194 | A1 | 8/2003 | Frank | |
| 2004/0099705 | A1 | 5/2004 | Skupin | |
| 2006/0248627 | A1 | 11/2006 | Austin et al. | |
| 2008/0276357 | A1 * | 11/2008 | Sigmon et al. | 2/458 |
| 2009/0025126 | A1 * | 1/2009 | Crossman et al. | 2/456 |
| 2009/0211000 | A1 | 8/2009 | Roux | |
| 2009/0277936 | A1 | 11/2009 | Rogers et al. | |
| 2009/0282595 | A1 * | 11/2009 | Branson et al. | 2/2.5 |
| 2010/0319381 | A1 * | 12/2010 | Hubler et al. | 62/259.3 |
| 2011/0004968 | A1 * | 1/2011 | Morgan | 2/2.5 |
| 2011/0072545 | A1 * | 3/2011 | Bennett | 2/2.5 |
| 2011/0113520 | A1 * | 5/2011 | Dennis | 2/2.5 |
| 2011/0181238 | A1 * | 7/2011 | Soar | 320/108 |

FOREIGN PATENT DOCUMENTS

| | | | |
|---|---|---|---|
| WO | WO2008/108856 | A2 | 9/2008 |

* cited by examiner

HANDS FREE BOMB SUIT TOOL CARRIER

STATEMENT OF GOVERNMENT INTEREST

The invention described herein may be manufactured and used by or for the Government of the United States of America for Governmental purposes without the payment of any royalties thereon or therefor.

BACKGROUND OF INVENTION

1. Field of the Invention

The present invention is directed to explosive ordnance disposal.

2. Description of Prior Art

Explosive ordnance disposal (EOD) technicians wear a heaving protective bomb suit. These technicians require tools to be used in evaluating and disabling an explosive device and often weapons to be used for their personal protection. The protective bomb suits are constructed to provide for maximum protection and do not provide for or accommodate the transport of tools and weapons.

Therefore, the technicians must carry the tools by hand, which occupies the technician's hands and limits the number of tools that can be transported to a bomb site. The tools can also be placed in a bag. The use of the bag also occupies the hands of the technician to transport the tools, and the technician often has a rather limited range of motion and sight due to the bomb suite. Therefore, a system is needed to transport tools and weapons to an incident site for technicians wearing bomb suits.

SUMMARY OF THE INVENTION

Systems and methods in accordance with exemplary embodiments of the present invention are directed to a bomb suit carrier and bomb suit carrier system that includes a sheet of fabric material shaped to fit within the front torso portion of a bomb suit. In one embodiment, the sheet of fabric material is ballistic nylon and is configured as an upper portion and a separate lower portion attached to the upper portion along a seam. In one embodiment, the sheet of fabric material is sized to attach to and to cover a chest plate carrier of the bomb suit.

The bomb suite carrier also includes a sheet of loop material attached to the sheet of fabric material and covering one side of the sheet of fabric material. This side is the front or outer side of the sheet of fabric material.

A plurality of parallel straps are attached to the front or outer side of the sheet of fabric material having the sheet of loop material. The parallel straps are attached to the side of the sheet of fabric material to form a pouch attachment ladder system (PALS), and each strap has loop material attached along its entire length. In one embodiment, each parallel strap has a width from about 1 inch to about 1.5 inches, and the parallel straps are spaced apart by a distance from about 1 inch to about 1.5 inches.

A hole passes through the sheet of fabric material and the sheet of loop materials and is sized to accommodate a rapid doffing handle of a bomb suit to which the bomb suit carrier is attached.

An attachment mechanism is provided attached to the sheet of fabric material and configured to secure the sheet of fabric material to the bomb suit. In one embodiment, the attachment mechanism includes a pair of side straps and a top strap attached to the sheet of fabric material and arranged to connect together on a back side of the sheet of fabric material opposite the side containing the sheet of loop material. The side straps and top strap include hook and look fasteners to secure the side straps and top strap together.

The attachment mechanism also includes an elastic section attach to the back side of the sheet of fabric material at an end of the sheet of fabric opposite the top strap and an adjustable back strap attached to the back side of the sheet of fabric material. In addition, a front strap is provided running along the side of the sheet of fabric material containing the sheet of loop material. The front strap includes hook material in contact with the loop material.

In one embodiment, a plurality of accessory components is attached to the front side of the sheet of fabric material that contains the sheet of loop material. Each accessory component uses at least one of a hook material in contact with the loop material and the pouch attachment ladder system to secure that accessory component to the sheet of fabric material. The accessory components include pouches, pistol holsters, magazine holders, knife holders, flashlight holders and combinations thereof.

The bomb suit carrier system also includes a bomb suit having a chest plate carrier attached to and covering a front torso portion of the bomb suite. The sheet of fabric material is shaped to fit cover the chest plate carrier, and the attachment mechanism is attached to the sheet of fabric material and configured to secure the sheet of fabric material to the chest plat carrier or the bomb suit.

In this embodiment, the attachment mechanism includes a pair of side straps and a top strap attached to the sheet of fabric material and arranged to connect together around the chest plate carrier on a back side of the sheet of fabric material opposite the front or outer side containing the sheet of loop material. The attachment mechanism also includes an elastic section attached to the back side of the sheet of fabric material at an end of the sheet of fabric opposite the top strap. The elastic section size is sized and shaped to accept an end of the chest plate carrier. Therefore, the bottom of the chest plate carrier fits in the elastic section like a pocket.

In one embodiment, the attachment mechanism includes an adjustable back strap attached to the back side of the sheet of fabric material and running between the chest plate carrier and the bomb suit. The attachment mechanism includes a front strap running along the side of the sheet of fabric material containing the sheet of loop material. The front strap includes hook material in contact with the loop material.

The bomb suit carrier system includes a plurality of accessory components attached to side of the sheet of fabric material containing the sheet of loop material. Each accessory component uses at least one of a hook material in contact with the loop material and the pouch attachment ladder system to secure that accessory component to the sheet of fabric material. The accessory components include pouches, pistol holsters, magazine holders, knife holders, flashlight holders and combinations thereof.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Figure 1:
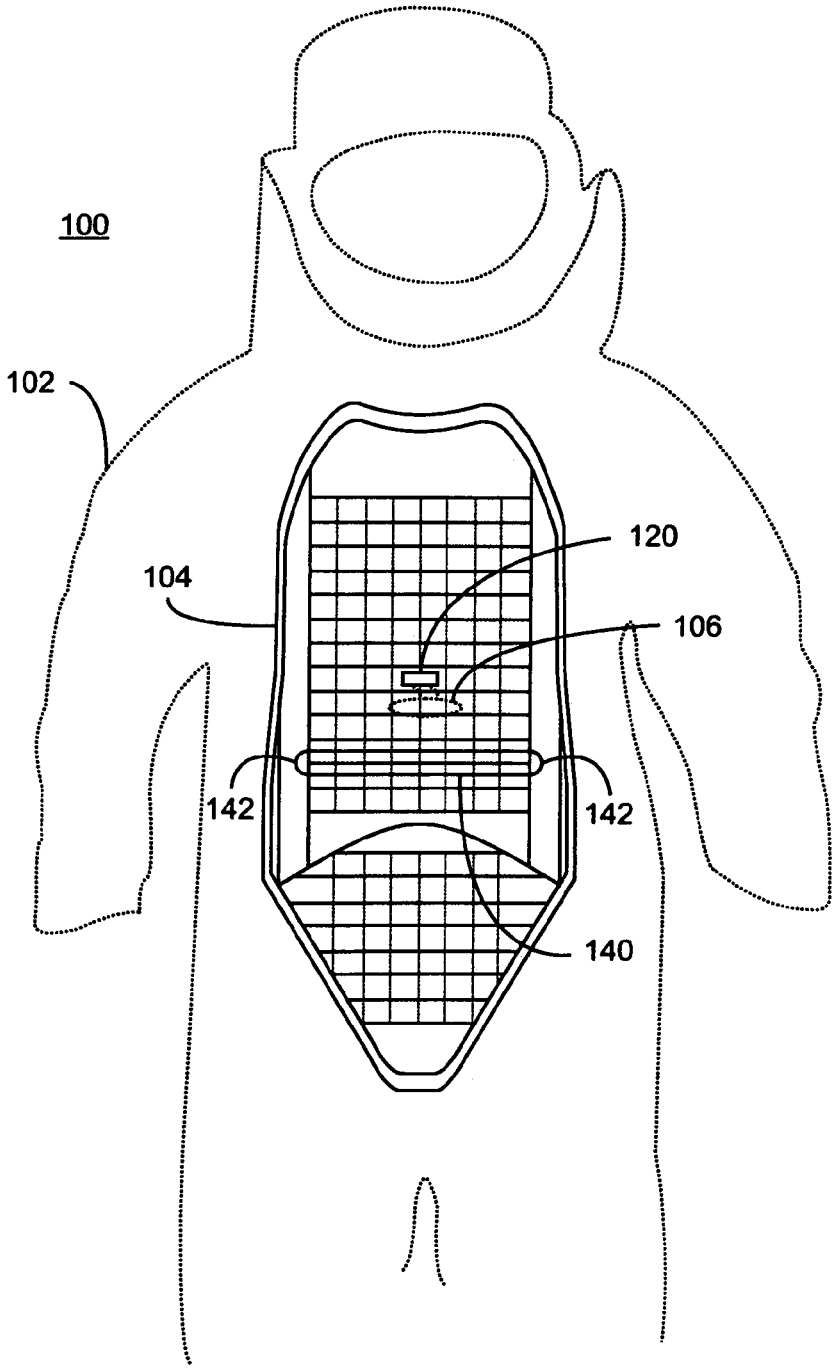
FIG. 1 is a view of a front side of an embodiment of a bomb suit carrier situated in a bomb suit in accordance with the present invention.

Referring initially to FIG. 1, an exemplary embodiment of a hands free bomb suit tool carrier system 100 in accordance with the present invention is illustrated. The tool carrier system 100 includes a bomb suit 102 and a hands free bomb suit carrier 104 that is attached to and fixedly secured to the front of the bomb suit. Suitable bomb suits 102 to be used with the tool carrier system 100 include, but are not limited to, the Explosive Ordnance Division (EOD®) 8 and EOD® 9 Bomb Suits that are commercially available from the Allen-Vanguard Corporation of Ottawa, Ontario Canada.

Figure 2:
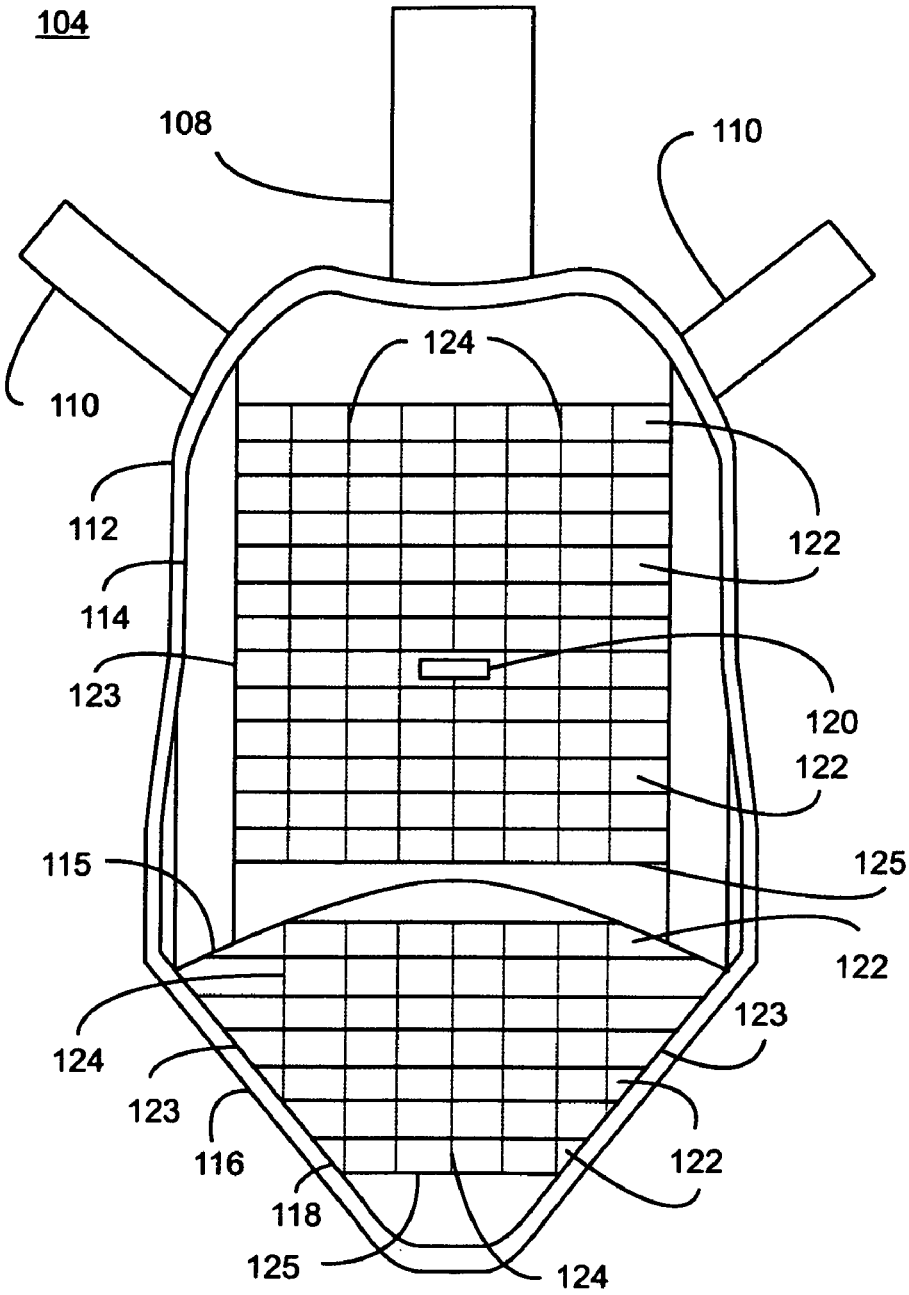
FIG. 2 is another view of the front side of the bomb suit carrier illustrating the top and side straps.
Figure 3:
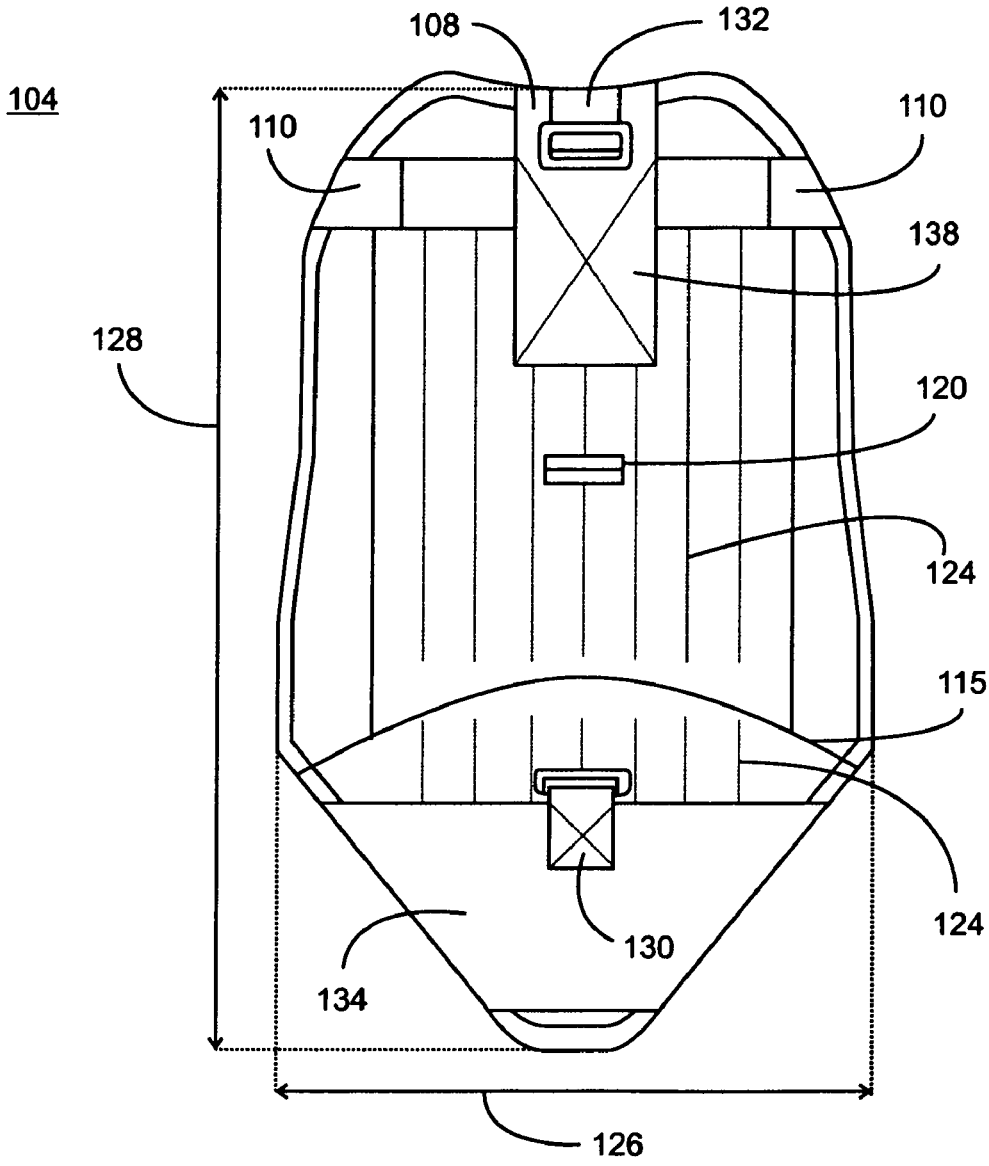
FIG. 3 is a view of the back side of the bomb suit carrier.
Figure 4:
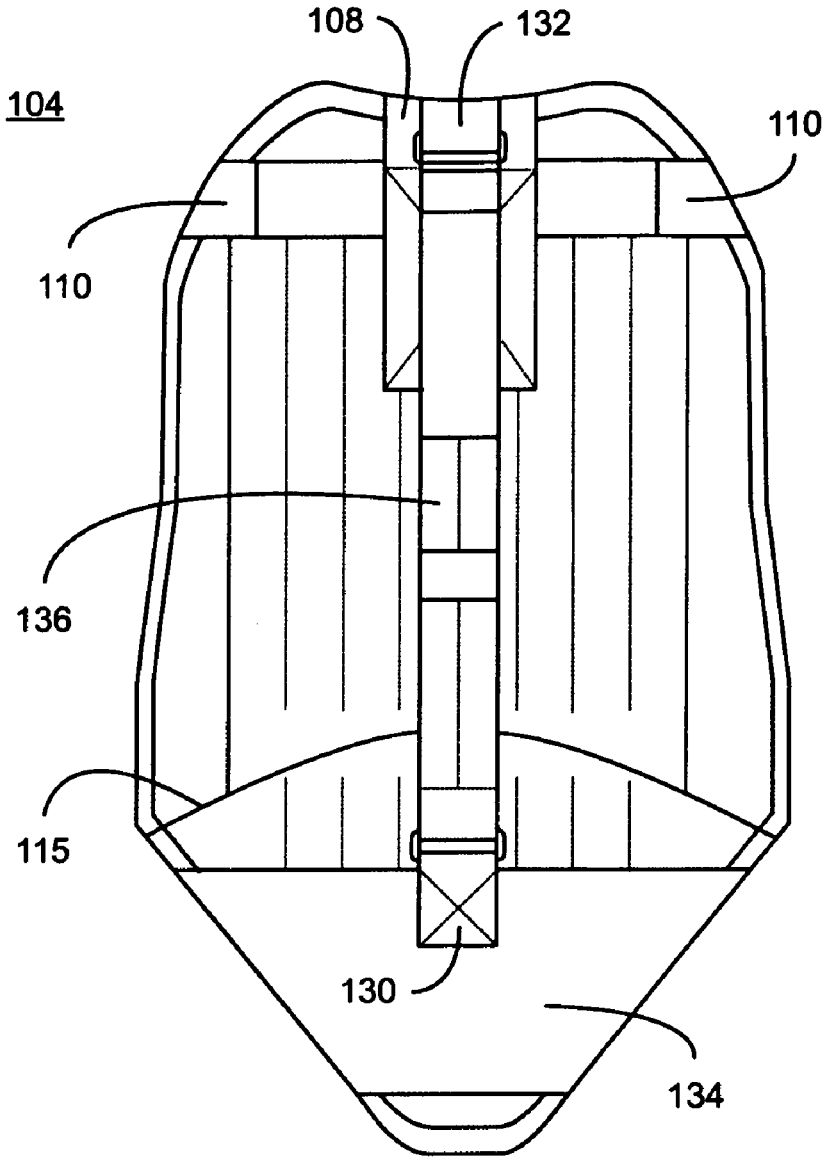
FIG. 4 is another view of the back side of the bomb suit carrier with a back attachment suit attached.

Referring to FIGS. 2-4, an exemplary embodiment of the hands free bomb suite carrier 104 is illustrated. The bomb suit carrier is constructed from two panels, an upper panel 112 and a lower panel 116 that are joined together along a seam 115. The two panels together have a suitable size and shape to cover the front torso area of the bomb suit and to fit over the chest plate carrier of the bomb suit. In one embodiment, as indicated in FIG. 3, the two joined panels have a width 126 of about 11.5 inches and a length 128 of about 26.5 inches.

The upper and lower panels are constructed of a layer of flexible fabric. Suitable fabrics include, but are not limited to, ballistic nylon. A complimentary sheet of loop material 114 is attached to the front of the upper panel 112. Similarly, a complimentary sheet of loop material 118 is attached to the front of the lower panel 116. These loop materials have a complimentary shape so that the entire front surface of the upper and lower panels contain loop material. The loop material is one half of a two part hook and loop type fastener. Therefore, any object or tool having the complimentary hook portion of the hook and loop type fastener can be attached to any point on the front of the bomb suit carrier 104. The loop materials are attached to the upper and lower panel using any suitable attachment mechanism. In an exemplary embodiment, the loop materials are attached using stitching.

Running horizontally along the upper and lower panels is a plurality of parallel straps 122. Each strap is stitched to the upper or lower panel along its ends 123. The straps are not attached to the upper and lower panels along the sides 125 or horizontal surfaces. A plurality of vertical stitches 124 are made through all of the straps 122. As illustrated herein, all stitches are shown as dashed lines. These stitches are made, for example, at intervals from about 1 inch to about 1.5 inches, and in particular, about 1.25 inches, along the length of each strap 122. Each strap has a width from about 1 inch to about 1.5 inches and is constructed from a flexible fabric that has loop material on its outer surface.

Therefore, even with the straps attached, the entire front of the bomb suit carrier 104 is loop material. In addition, the size, spacing and stitching of the straps on the front of the upper and lower panels creates a Pouch Attachment Ladder System (PALS) that can also be used to attach tools and tool carriers to the bomb suit carrier. The PALS system is known and available in the art.

A hole 120 is provided generally in the center of the bomb suit carrier 104. This hole is sized to accommodate the rapid doffing handle 106 of the bomb suit 102 (FIG. 1). Therefore, even with the bomb suit carrier 104 attached to the bomb suit 102, the rapid doffing handle 106 can be accessed and utilized for rapid removal of the bomb suit 102.

In order to securely attach the bomb suit carrier 104 to the bomb suit 102, the bomb suit carrier includes a top strap 108 and a pair of side straps 110. In one embodiment, the top strap 108 has a width of about 4 inches and each side strap has a width of about 2 inches. As is illustrated in FIG. 3, the two side straps 110 are folded across the back of the bomb suit carrier 104. The side straps 110 include hook and loop fastening material to secure the straps together. Therefore, the chest plate carrier (not shown) can be placed between the bomb suit carrier 104 and the side straps 110. The top strap 108 is folded down over the side straps 110 and can be secured to the side straps using appropriately placed hook and loop fastening material. In one embodiment, the exposed surface 138 of the top strap can include either a hook material or a loop material that accommodates hook or loop material on the bomb suit 102 to further secure the bomb suit carrier 104 to the bomb suit 102.

On the back of the lower portion 116 of the bomb suit carrier a large elastic section 134 is provided. The large elastic section is constructed from an elastic material and forms an elastic pocket into which the lower portion of the chest plate carrier of the bomb suit is placed. Therefore, the top and side straps secure the bomb suit carrier to the top of the chest plate carrier, and the large elastic section 134 secures the bomb suit carrier to the bottom of the chest plate carrier.

As shown in FIG. 4, additional attachment support is provided by an adjustable center back strap 136 that is routed behind the chest plate carrier. In one embodiment, the adjustable back strap 136 is about 2 inches wide. The adjustable back strap 136 is threaded through an upper attachment point D-ring 132 that is secured to the top of the bomb suit carrier 104 and a lower attachment point D-ring 130 that is secured to the bottom of the bomb suit carrier 104. The adjustable center back strap 136 includes both hook and loop material portions along its length to provide for adjusting the length of the back strap and securing the back strap to itself. The chest plate carrier is disposed between the back strap and the back of the bomb suite carrier.

Returning to FIG. 1, the bomb suit carrier 104 can be further secured to the bomb suit 102 using a flexible front strap 140, for example a 1 or 2 inch strap, that is looped through existing D-rings 142 on the bomb suit 102. The back of the front strap 140 that is in contact with the front of the bomb suit carrier 104 includes a hook material. Therefore, the front strap 140 securely attaches to the bomb suit carrier 104 completely across the width of the bomb suit carrier 104. The flexible front strap 140 also includes additional areas of hook and loop materials so that the strap can be secured to itself after it is looped through the D-rings.

In one embodiment, the hands free bomb suit tool carrier system of the present invention includes a variety of components that can be attached to the bomb suit carrier using the hook and loop fasteners, the PALS system or a combination of the two attachment mechanisms. Suitable materials for these components are the same as for the bomb suit carrier. FIGS. 5-9 illustrate an example of the types of components that can be included in the hands free bomb suite tool carrier system.

Figure 5:
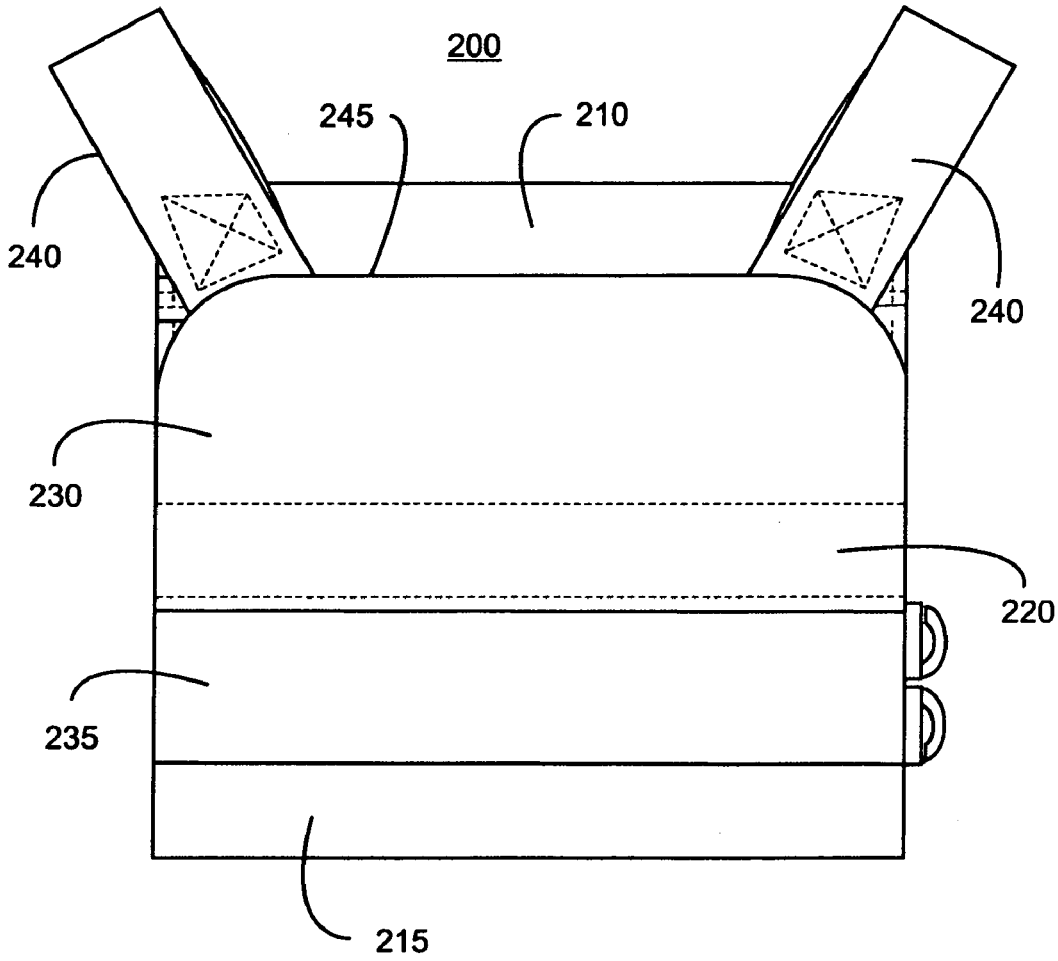
FIG. 5 is a view of the front of an embodiment of a tool pouch for use with the bomb suit carrier of the present invention.

Referring to FIG. 5, an exemplary embodiment of a pouch 200 is illustrated. The pouch is sized to fit on either the upper or lower portion of the bomb suit carrier and is sized to accommodate the tools or materials to be stored in the pouch. In one embodiment, the pouch 200 is a mesh pouch that includes mesh sections 230,235. Access to the interior of the mesh pocket is through the top 245 of the mesh pocket, which can be closed using a suitable closing mechanism such as a zipper or hook and loop fastener.

A hook material is used to form the back 210 portion of the pouch. In one embodiment, this hook portion extends around to the front 215 of the pouch. Therefore, the pouch can be attached to any portion of the bomb suit carrier by pressing the pouch against the loop material on the front of the bomb suit carrier. A pair of loops of flexible strap 240 is attached to the pouch 200 to provide a handle or grasping point for removing the pouch 200 from the bomb suit carrier 104. In one embodiment, a strip of loop material 220 is provided on the front of the pouch 200.

Figure 6:
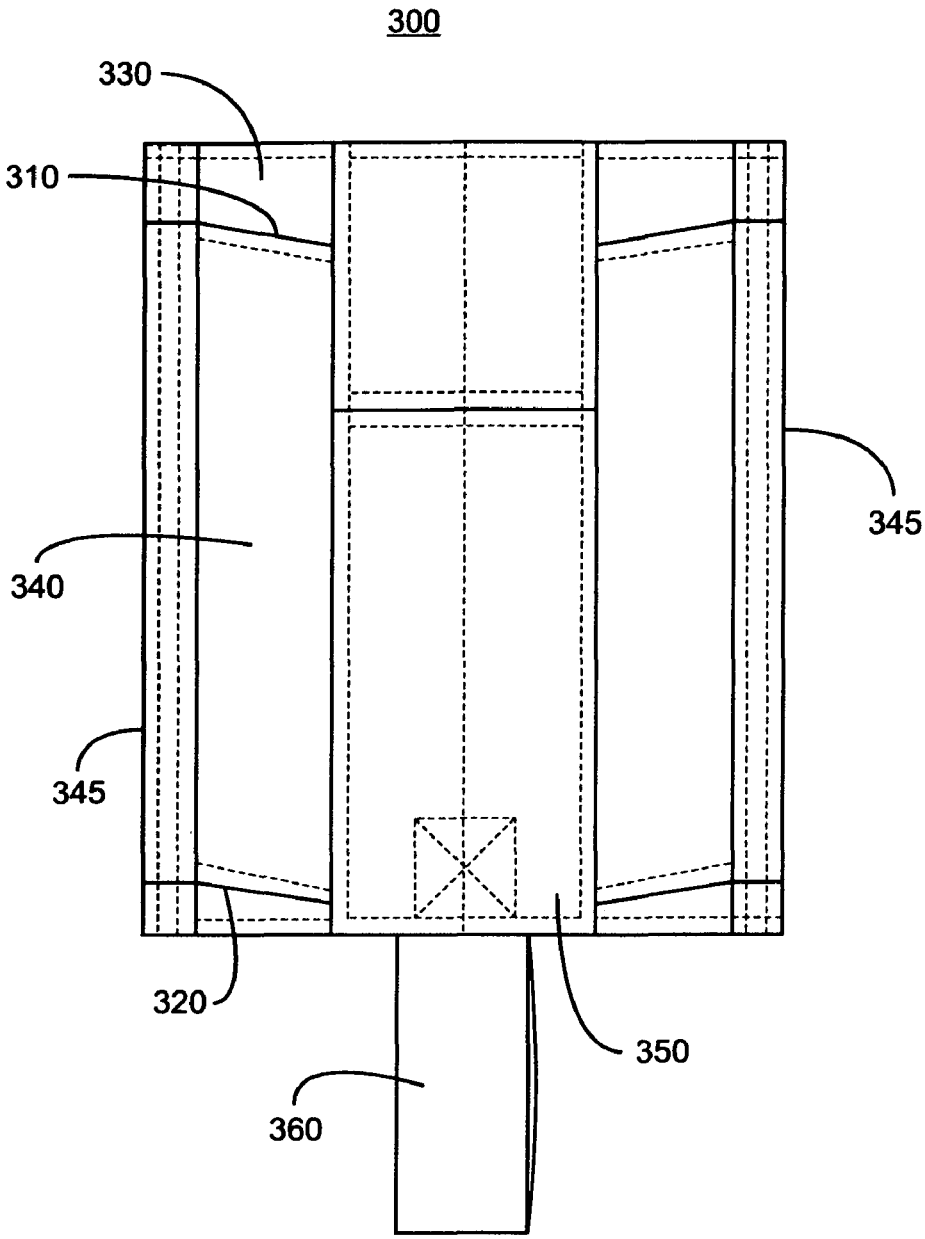
FIG. 6 is a view of the front of an embodiment of a pistol holster for use with the bomb suit carrier of the present invention.

Referring to FIG. 6, one component is a pistol holster 300. A front portion 340 is attached to a back portion 300 along the side edges 345 such that a top opening 310 and bottom opening 320 are provided for insertion of the pistol. A closing flap 350 is provided attached to the back portion 330 to secure the pistol in the holster. The flap 350 includes a strap loop 360 to act as a handle for opening the flap 350. In one embodiment, the back portion includes a hook material to provide for attachment of the holster to the bomb suit carrier. In addition, straps (not shown) can be attached to the holster that are sized and arranged to work with the PALS system of the bomb suit carrier.

Figure 7:
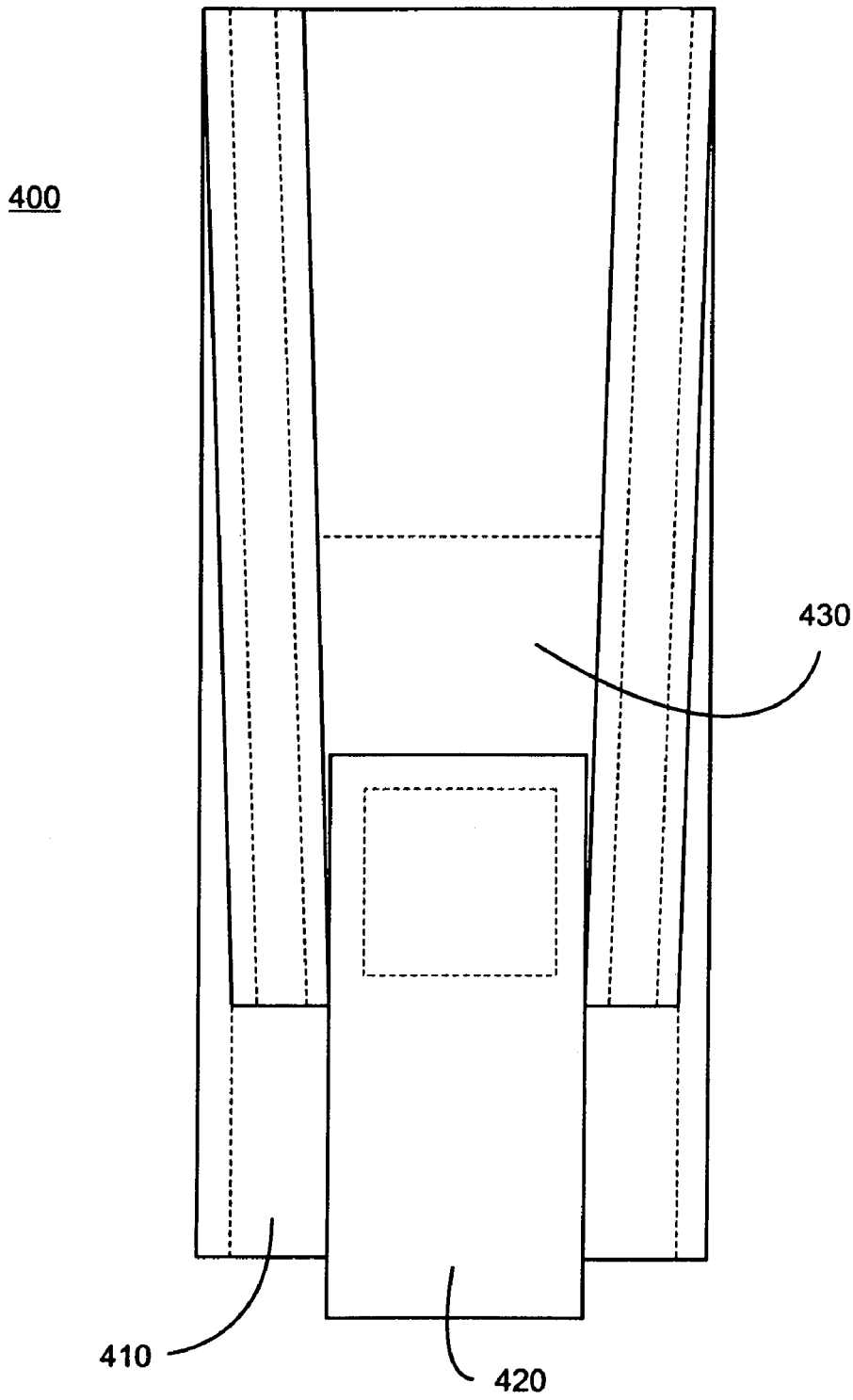
FIG. 7 is a view of the front of an embodiment of a magazine holder for use with the bomb suit carrier of the present invention.

Referring to FIG. 7, a magazine, clip or ammunition holder 400 is provided. In one embodiment, the clip holder 400 is formed from a length of material that is folded and stitched to form a pocket portion 410 that is sized to hold the desired pistol clip. A portion of the material is folded over to form a closure flap 430, and a flexible strap loop extends from the flap 430 to provide a handle for opening the clip holder 400. In one embodiment, the back portion includes a hook material to provide for attachment of the clip holder to the bomb suit carrier. In addition, straps (not shown) can be attached to the clip holder that are sized and arranged to work with the PALS system of the bomb suit carrier.

Figure 8:
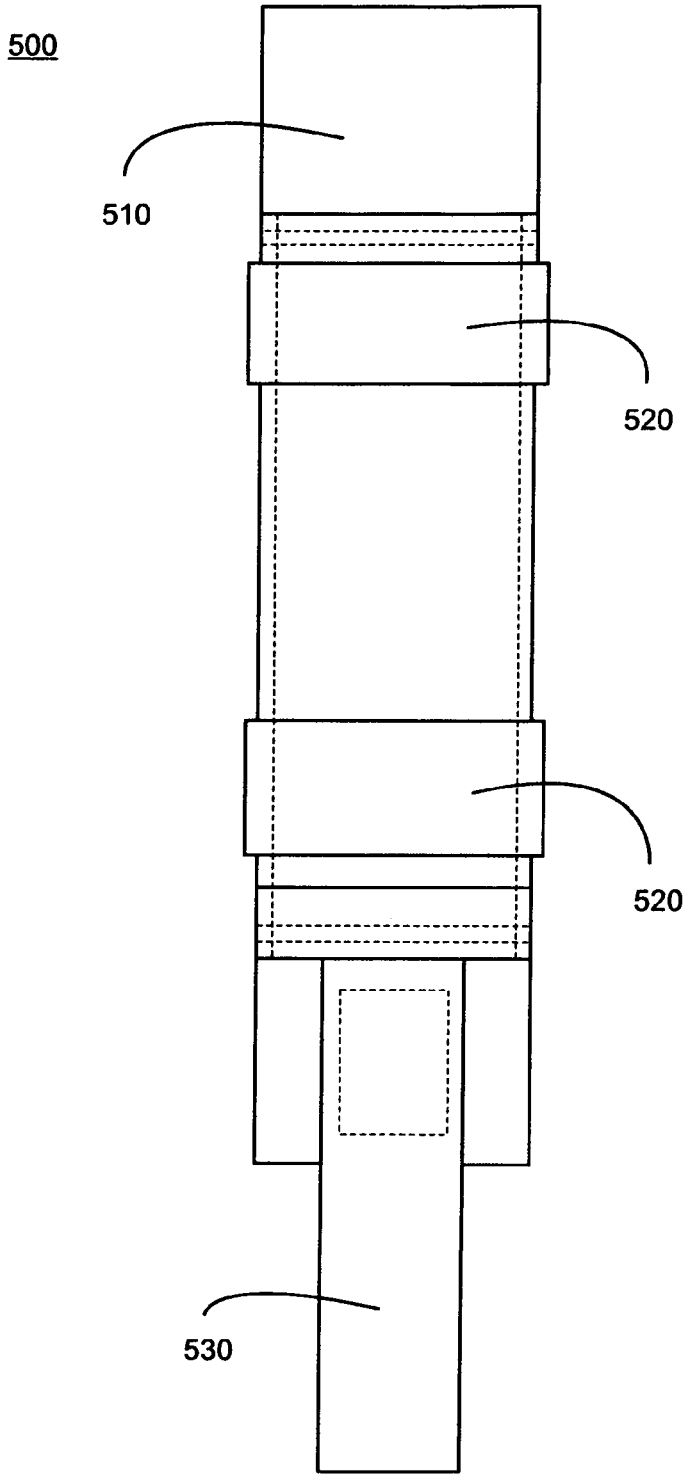
FIG. 8 is a view of the front of an embodiment of a flashlight holder for use with the bomb suit carrier of the present invention.

Referring to FIG. 8, a flashlight holder 500 is provided. This flashlight holder includes a main portion 510 that runs the length of the flashlight holder 500. A flexible strap loop 530 extends from the main portion and provides a handle to be used in removing the flashlight holder from the bomb suite carrier. At least the back of the main portion 510 includes a hook material that is used to attach the flashlight holder to the bomb suit carrier. A series of loops 520 are attached to the front of the main portion 510 and are used to secure a flashlight in the flashlight hold.

Figure 9:
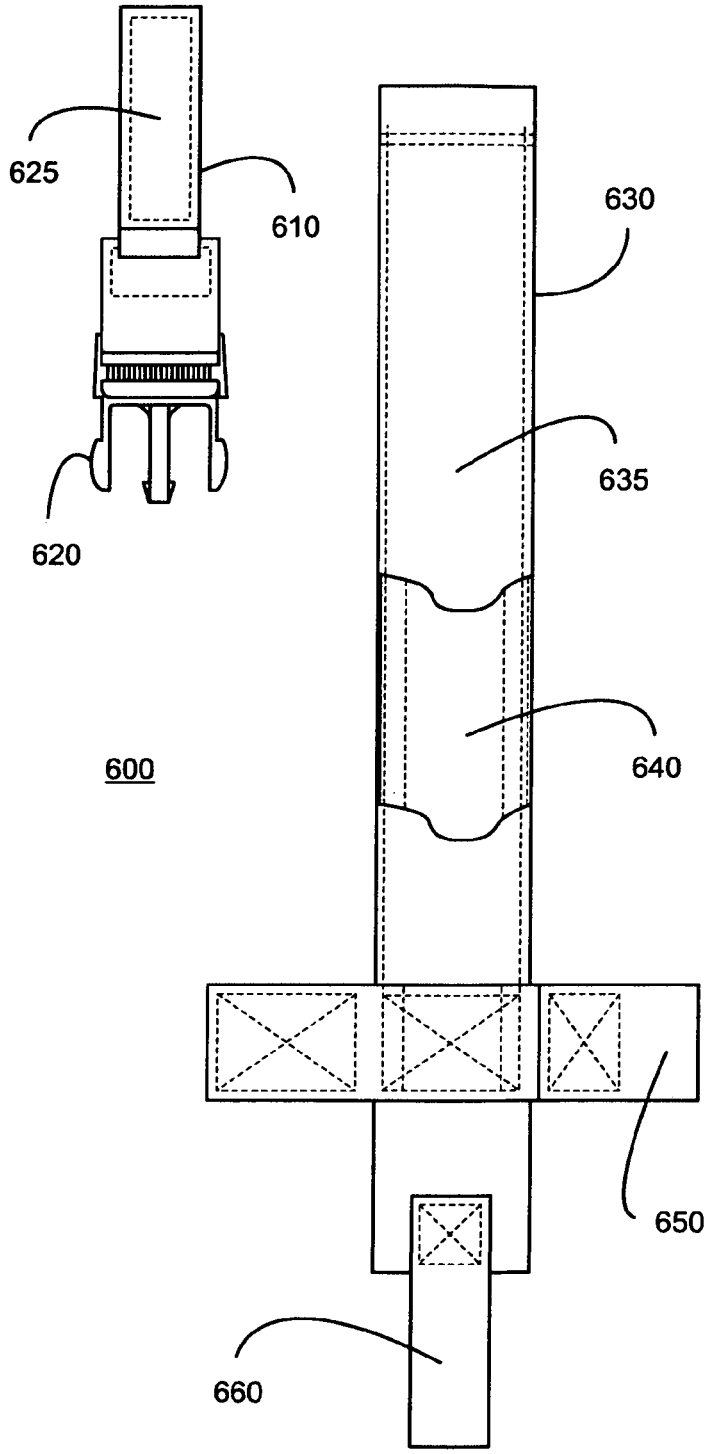
FIG. 9 is a view of the front of an embodiment of a knife holder for use with the bomb suit carrier of the present invention.

Referring to FIG. 9, a knife carrier 600 is illustrated. As illustrated, the knife carrier includes two parts. A first part 610 includes a first part 620 of a two part quick release clip attached to a length of flexible strap 625. The flexible strap is arranged for attachment to the PALS system of the bomb suit carrier, and the first part 620 of the quick release clip attaches to a second part of the quick release strap that is generally attached to the knife sheath. The second part 630 of the knife carrier includes a main body portion 635 of flexible strap. The main body portion 635 can include a hook material to provide for attachment of the main body portion to the bomb suit carrier. In addition, straps (not shown) can be attached to the main body portion that are sized and arranged to work with the PALS system of the bomb suit carrier. A section of fabric 640 is stitched to the main body portion 635 to form a sleeve through which the knife sheath is passed. The end of the knife sheath is held in place by a section of flexible strap 650 attached near one end of the main body 630. This portion of flexible strap can include portions of hook and loop type fastener fabric to secure the flexible strap around the knife sheath. A loop of flexible strap 600 is also attached to the main body portion to act as a handle to remove the knife carrier from the bomb suit carrier.

Figure 10:
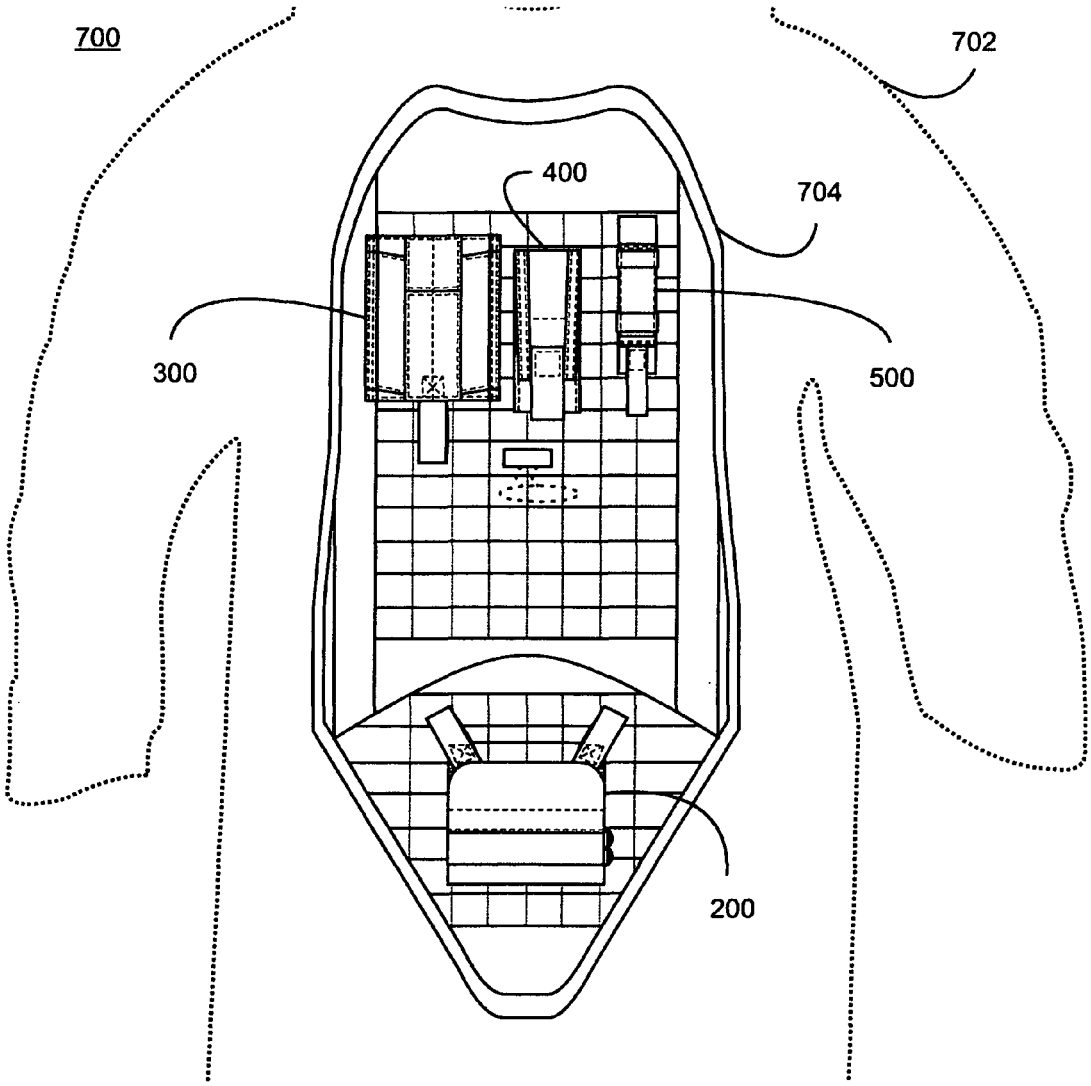
FIG. 10 is a view of a front side of an embodiment of a bomb suit carrier system in accordance with the present invention.

An embodiment of the bomb suit carrier system 700 with the bomb suit carrier 704 attached to the bomb suit 702 and the various components attached to the bomb suite carrier 704 is illustrated in FIG. 10.

It will be understood that many additional changes in details, materials, steps, and arrangements of parts which have been described herein and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A combination bomb suit and carrier, comprising:

a sheet of fabric material being shaped to fit within the front torso portion of said bomb suit;

a sheet of loop material being attached to the sheet of fabric material and covering one side of the sheet of fabric material;

a plurality of parallel straps being attached to the side of the sheet of fabric material having the sheet of loop material, wherein the plurality of parallel straps are attached to the side of the sheet of fabric material to form a pouch attachment ladder system and each strap comprises loop material along its entire length;

a hole passing through the sheet of fabric material and the sheet of loop materials and sized to accommodate a rapid doffing handle of said bomb suit to which said bomb suit carrier is attached; and an attachment mechanism being attached to the sheet of fabric material and configured to secure the sheet of fabric material to said bomb suit.

2. The combination bomb suit and carrier of claim 1, wherein the sheet of fabric material comprises ballistic nylon.

3. The combination bomb suit and carrier of claim 1, wherein the sheet of fabric material comprises an upper portion and a separate lower portion attached to the upper portion along a seam.

4. The combination bomb suit and carrier of claim 1, wherein the sheet of fabric material is sized to attach to and to cover a chest plate carrier of the bomb suit.

5. The combination bomb suit and carrier of claim 1, wherein each parallel strap comprises a width from about 1 inch to about 1.5 inches and the parallel straps are spaced apart by a distance from about 1 inch to about 1.5 inches.

6. The combination bomb suit and carrier of claim 1, wherein the attachment mechanism comprises a pair of side straps and a top strap attached to the sheet of fabric material and arranged to connect together on a back side of the sheet of fabric material opposite the side containing the sheet of loop material.

7. The combination bomb suit and carrier of claim 6, wherein the side straps and top strap comprise hook and look fasteners to secure the side straps and top strap together.

8. The combination bomb suit and carrier of claim 6, wherein the attachment mechanism further comprises an elastic section attach to the back side of the sheet of fabric material at an end of the sheet of fabric opposite the top strap.

9. The combination bomb suit and carrier of claim 6, wherein the attachment mechanism further comprises an elastic section attach to the back side of the sheet of fabric material at an end of the sheet of fabric opposite the top strap, and wherein the attachment mechanism further comprises an adjustable back strap attached to the back side of the sheet of fabric material.

10. The combination bomb suit and carrier of claim 6, wherein the attachment mechanism further comprises an elastic section attach to the back side of the sheet of fabric material at an end of the sheet of fabric opposite the top strap, wherein the attachment mechanism further comprises an adjustable back strap attached to the back side of the sheet of fabric material, wherein the attachment mechanism further comprises a front strap, which runs along the side of the sheet of fabric material, and contains, and wherein the sheet of loop material, the front strap comprises hook material in contact with the loop material.

11. The combination bomb suit and carrier of claim 1, further comprising a plurality of accessory components attached to side of the sheet of fabric material containing the sheet of loop material, wherein each of said plurality of accessory components uses at least one of a hook material in contact with the loop material and the pouch attachment ladder system to secure that accessory component to the sheet of fabric material.

12. The combination bomb suit and carrier of claim 11, wherein said each of said plurality of accessory components comprises at least one of pouches, pistol holsters, magazine holders, knife holders, and flashlight holders.

13. A bomb suit carrier system, comprising:

A bomb suit having a chest plate carrier being attached to and covering a front torso portion of the bomb suit;

a sheet of fabric material being shaped to fit cover the chest plate carrier;

a sheet of loop material being attached to the sheet of fabric material and covering one side of the sheet of fabric material;

a plurality of parallel straps being attached to the side of the sheet of fabric material having the sheet of loop material, the plurality of parallel straps are attached to the side of the sheet of fabric material to form a pouch attachment ladder system and each strap comprising loop material along its entire length;

a hole passing through the sheet of fabric material and the sheet of loop materials and sized to accommodate a rapid doffing handle of the bomb suit; and an attachment mechanism being attached to the sheet of fabric material and configured to secure the sheet of fabric material to the chest plate carrier or the bomb suit.

14. The bomb suit carrier system of claim 13, wherein the attachment mechanism comprises a pair of side straps and a top strap attached to the sheet of fabric material and arranged to connect together around the chest plate carrier on a back side of the sheet of fabric material opposite the side containing the sheet of loop material.

15. The bomb suit carrier system of claim 14, wherein the attachment mechanism further comprises an elastic section attached to the back side of the sheet of fabric material at an end of the sheet of fabric opposite the top strap, and wherein the elastic section is sized to accept an end of the chest plate carrier.

16. The bomb suit carrier system of claim 14, wherein the attachment mechanism further comprises an elastic section attached to the back side of the sheet of fabric material at an end of the sheet of fabric opposite the top strap, wherein the elastic section is sized to accept an end of the chest plate carrier, and wherein the attachment mechanism further comprises an adjustable back strap attached to the back side of the sheet of fabric material and running between the chest plate carrier and the bomb suit.

17. The bomb suit carrier system of claim 14, wherein the attachment mechanism further comprises an elastic section attached to the back side of the sheet of fabric material at an end of the sheet of fabric opposite the top strap, wherein the elastic section is sized to accept an end of the chest plate carrier, wherein the attachment mechanism further comprises an adjustable back strap attached to the back side of the sheet of fabric material and running between the chest plate carrier and the bomb suit, and wherein the attachment mechanism further comprises a front strap running along the side of the sheet of fabric material containing the sheet of loop material, the front strap comprises hook material in contact with the loop material.

18. The bomb suit carrier system of claim 13, further comprising a plurality of accessory components attached to side of the sheet of fabric material containing the sheet of loop material, wherein each of said plurality of accessory components uses at least one of a hook material in contact with the loop material and the pouch attachment ladder system to secure that accessory component to the sheet of fabric material.

19. The bomb suit carrier system of claim 18, wherein said each of said plurality of the accessory components comprise at least one of pouches, pistol holsters, magazine holders, knife holders, and flashlight holders.

* * * * *